United States Patent [19]

Wilson et al.

[11] 4,296,573

[45] Oct. 27, 1981

Best Available Copy

[54] AUDIENCE CONTROL BARRIER

[75] Inventors: Kermit H. Wilson, Edina; Ronald R. Carlson, Excelsior, both of Minn.

[73] Assignee: Sico Incorporated, Minneapolis, Minn.

[21] Appl. No.: 58,669

[22] Filed: Jul. 18, 1979

[51] Int. Cl.[3] ..... E04D 3/10; E04H 17/18

[52] U.S. Cl. ..... 52/6; 256/26

[58] Field of Search ..... 52/6, 7, 146; 256/24, 256/65, 26; 405/272, 282; 272/3-5, 9; 108/50

[56] References Cited

U.S. PATENT DOCUMENTS

| | | | |
|---|---|---|---|
| 534,545 | 2/1895 | Breadner | 256/24 |
| 1,274,621 | 8/1918 | Sopata . | |
| 1,281,400 | 10/1918 | Larnell . | |
| 2,018,920 | 10/1935 | Mette | 405/284 |
| 2,560,878 | 7/1951 | Kyle . | |
| 2,855,037 | 10/1958 | Stiffel . | |
| 3,055,460 | 9/1962 | Maroney . | |
| 3,247,628 | 4/1966 | Miller | 52/6 |
| 3,258,884 | 7/1966 | Wenger | 52/6 |
| 3,469,822 | 9/1969 | O'Brien | 256/26 |
| 3,897,668 | 8/1975 | McDonnell | 52/632 |
| 4,037,382 | 7/1977 | Jacobs | 52/638 |
| 4,038,800 | 8/1977 | Daley | 52/507 |
| 4,054,096 | 10/1977 | Wilson | 108/113 |
| 4,124,196 | 11/1978 | Hipskind | 256/24 |
| 4,129,916 | 12/1978 | Schlesinger | 272/3 |

FOREIGN PATENT DOCUMENTS

| | | |
|---|---|---|
| 641331 | 8/1950 | United Kingdom . |
| 679297 | 9/1952 | United Kingdom . |
| 883705 | 12/1961 | United Kingdom . |
| 1234204 | 6/1971 | United Kingdom . |
| 1266357 | 3/1972 | United Kingdom . |
| 1329411 | 9/1973 | United Kingdom . |

*Primary Examiner*—Reinaldo P. Machado

*Attorney, Agent, or Firm*—Merchant, Gould, Smith, Edell, Welter & Schmidt

[57] ABSTRACT

An audience control barrier for use with an elevated stage, for maintaining physical separation for performers on the stage from an audience on the other side of the barrier. The barrier is modular in form, each module including a rigid panel and brackets for supporting the panel in vertical orientation. Interconnection means on the panels permit edge to edge interconnection of modules to form a stage barrier of the desired width. According to a preferred feature, the brackets which support the panels include a top bracket having an angled flange which may be driven into wedging engagement with the top edge of the panel to hold it in place. Means are provided for interconnecting the brackets which support the panels to the legs of the stage. In a preferred form, the interconnection means comprises a hook plate configured to fit around more than half of the periphery of the stage leg, and a flipper or gate which may be moved to locking position to secure the barrier to the stage legs.

13 Claims, 10 Drawing Figures

AUDIENCE CONTROL BARRIER

TECHNICAL FIELD OF THE INVENTION

The present invention pertains to the field of portable stages and auxiliary equipment therefor. More particularly, the present invention pertains to an audience control barrier for use with a portable stage for maintaining physical spacing between the audience and the stage.

BACKGROUND OF THE PRIOR ART

Portable stages have come into widespread use in schools, hotels, convention centers, and other institutions having multiple use facilities, where it is sometimes necessary to set up a stage for use in a display or performance. In the case of a trade show or the like, a stage or a number of stages may be set up for displaying items for view by persons in attendance. In the case of a performance, such as a musical performance, the performers are positioned on an elevated stage so the audience can see and hear them. One example of a portable stage for this type of application is the elevationally adjustable folding stage shown in U.S. Pat. No. 4,054,096, to Wilson et al. The stage of that patent may be adjusted to the desired height and a number of such stage sections can be positioned adjacent each other and interconnected to form an extended stage area.

It is sometimes desirable or even necessary to ensure physical separation of the audience from the stage. The primary example of situations in which this separation is necessary involves performances by popular musical performers, where there has sometimes been a tendency on the part of an enthusiastic and youthful audience to reach up onto the stage or even try to climb up onto the stage. To maintain this separation, it has been necessary to station guards or ushers on the floor in front of the stage, but in the case of particularly enthusiastic audiences, they may not be able to control the audience and keep them from the stage.

In addition, there are other situations in which it is desirable to keep the audience separated from the stage. For example in the case of a display of expensive, delicate or potentially dangerous equipment, it may be necessary to keep the viewers at more than arm's length from the stage.

In order to maintain audience separation from the stage, there is a need for an audience control barrier that can be used with stages, particularly portable stages. To be fully effective at filling the needs outlined above, the barrier should be strong and secure enough to withstand considerable pressure from an audience, and ideally it should be flexible enough in its design to be readily adapted to different heights, widths and configurations of stages. It should also be modular for ease in setup and takedown for storage, and means should be provided for quickly but securely fastening the barrier to the stage.

SUMMARY OF THE INVENTION

According to the present invention, there is provided a modular audience control barrier, for use with an elevated stage having support legs. The barrier comprises one or more modules, each including a rigid panel and bracket means for supporting the panel in a vertical orientation. Means are provided for interconnecting the modules in edge to edge relationship to form an extended barrier of the desired width. The brackets preferably have a vertical member including means for receiving and securing the upper edge of the panel, and a horizontal member for interconnection to a leg of the stage. The horizontal member is preferably adjustable in length so that the spacing between the barrier and the stage may be adjusted.

According to a further aspect of the invention, the means associated with the vertical member for receiving and holding the upper edge of the panel includes an angled member having a top portion extending along the upper edge of the panel, and a flange portion extending downwardly along the face of the panel, said flange portion being tapered outwardly at a small angle to wedge and hold the top edge of the panel when the vertical member is driven downward.

According to another aspect of the invention, a particularly advantageous interconnection means for connecting the horizontal member of the bracket to the leg of the stage may be provided. The interconnection means includes a hook plate configured in conformity with the cross sectional configuration of the leg to engage more than half the periphery thereof, and a flipper pivoted to the top of the hook plate for movement between a vertical open position which permits placing the hook plate about the leg, and a horizontal locked position which prevents lateral movement of the stage leg out of the hook plate.

DETAILED DESCRIPTION OF THE INVENTION

Figure 1:
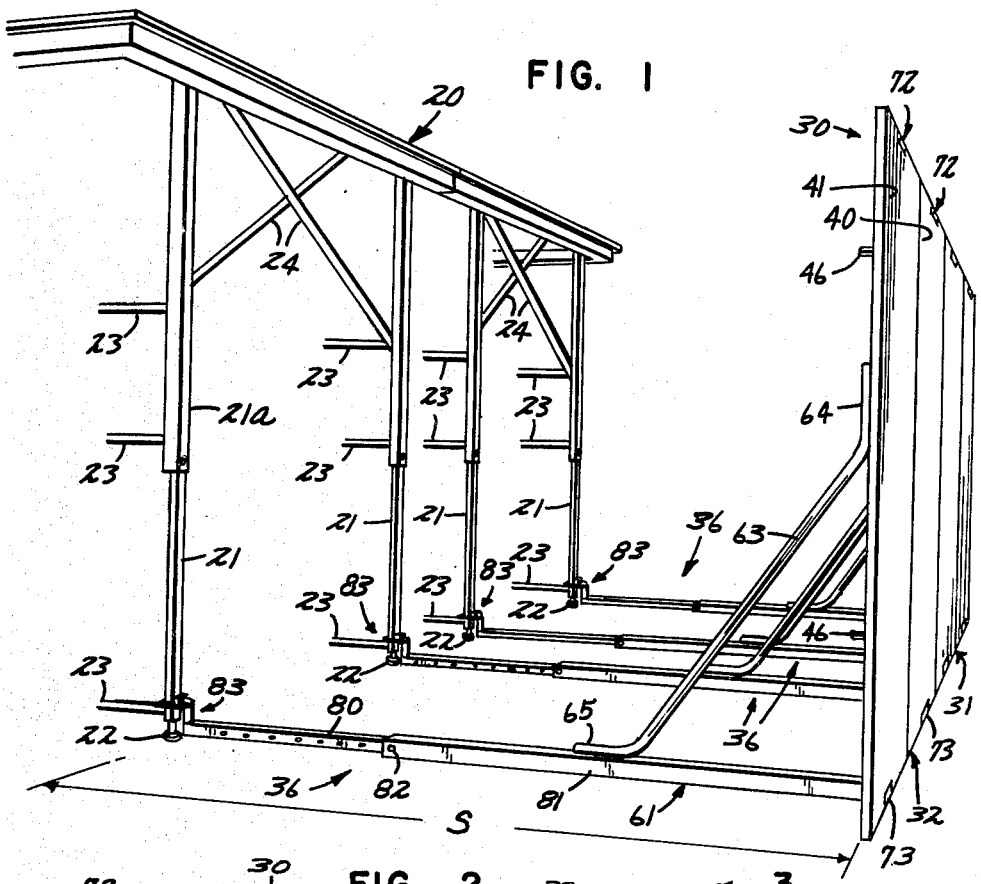
FIG. 1 is a view in perspective of the barrier according to the present invention in use with conjunction with an elevated stage.
Figure 2:
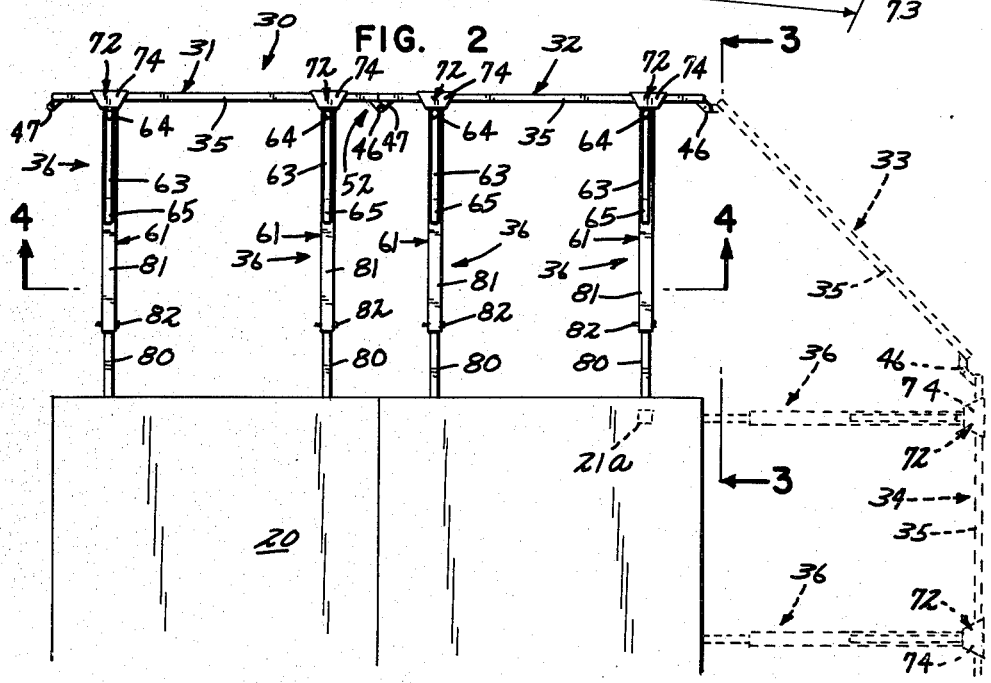
FIG. 2 is a plan view of the barrier and stage of FIG. 1, additional barrier modules being indicated in broken line.

FIGS. 1 and 2 show, in perspective and top plan, respectively, the audience control barrier of the present invention used in conjunction with a stage. The audience control barrier is generally designated by reference number 30, and the stage is generally designated by reference number 20. As mentioned above, the present invention can be advantageously used with a stage of the type shown in U.S. Pat. No. 4,054,096 to Wilson et al. Mobile elevationally adjustable stages according to that patent can be positioned side by side to make up an extended stage surface of any desired shape or size. In FIGS. 1 and 2, two such stage sections are shown side by side for illustrative purposes, but it will be understood that any number of such stages could be used and the barrier 30 could be extended as necessary to cover the width of the stage. Further, it will be appreciated that other types of stages in addition to those of the type covered in the above-mentioned patent can be used with the audience control barrier of the present invention.

In use, the performers are positioned on top of stage 20, and the audience is positioned on the side of barrier 30 away from the stage, i.e., to the right of barrier 30 in FIG. 1. Barrier 30 is in the preferred embodiment approximately 5 feet in height, and the elevational adjustment of stage 20 is selected in conjunction with this height, and in conjunction with the size and shape of the audience area, so that the performers will be visible to the audience over the barrier except right in front of the barrier. The height of 5 feet in the preferred embodiment discourages attempts by the audience to climb over the barrier, and if necessary, guards can be stationed at intervals in the space between barrier 30 and stage 20.

FIG. 1 and the solid line of FIG. 2 shows two stage sections and two modules of the barrier 30 positioned along the front of the stage. Broken lines in FIG. 2 show placement of an additional module to the side of the stage and another section of the barrier diagonally guarding the corner of the stage. It will be understood that additional modules or sections of the barrier can be provided on any side, end or corner of the stage as required for a given usage.

Referring now to FIGS. 1 and 2 in detail, stage 20 is elevated on legs 21 having leveling screws 22 at their bottoms. The individual stage sections of stage 20 have appropriate cross members 23 and diagnonal braces 24, according to the design of the particular stage section used. Audience control barrier 30 according to the invention includes modules identified by the reference numbers 31, 32, 33, and 34. Module 32 is typical as shown also in FIG. 4, and it comprises a vertical panel 35 and a pair of support brackets 36, although occasions may arise as in module 33 at the corner of the stage where no support brackets are needed. Convenience of manufacture and assembly is promoted if the panels are of uniform size and the brackets are of identical construction.

Figures 4, 5, 6:
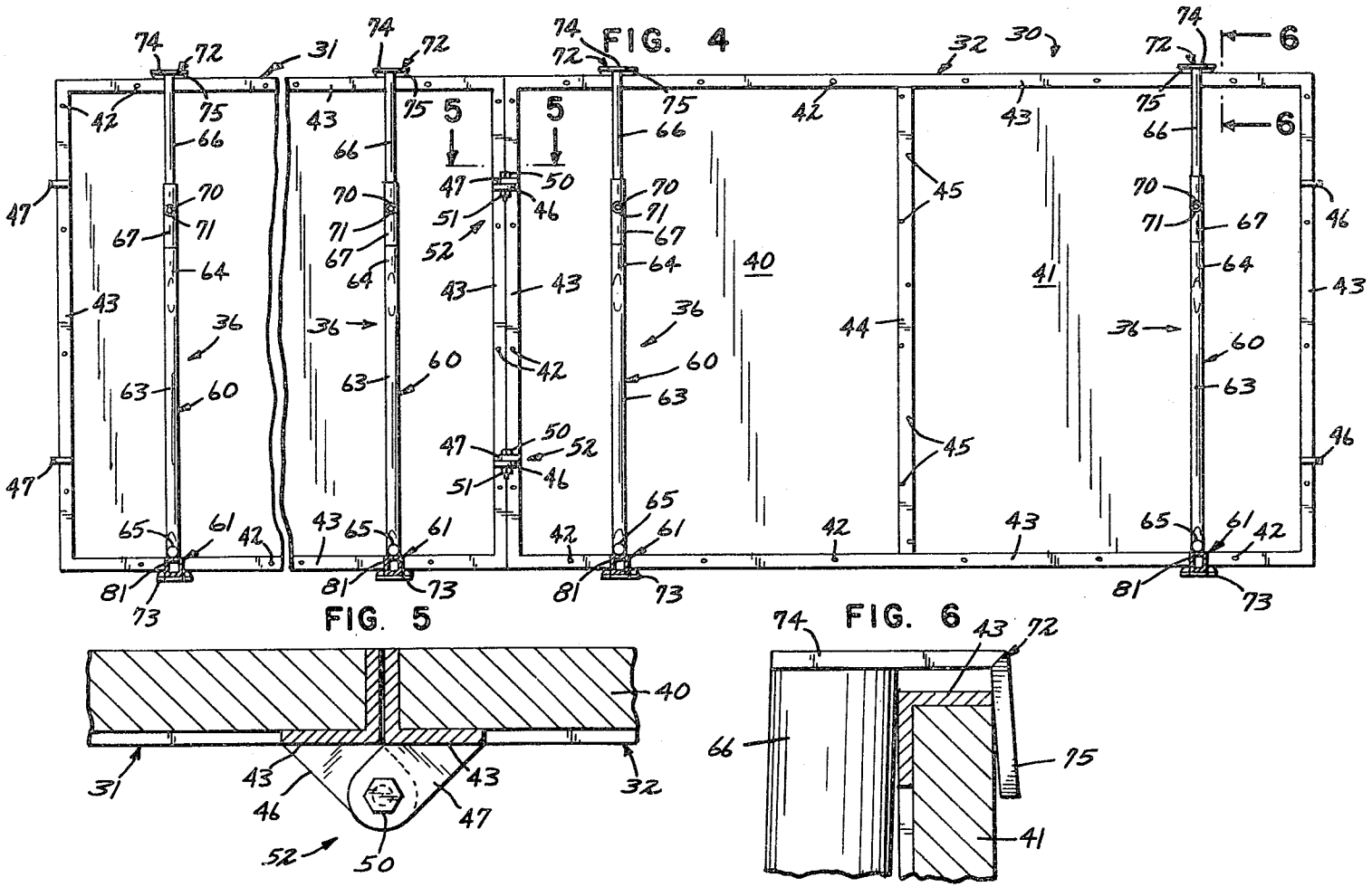
FIG. 4 is a view of the barrier in rear elevation.
FIG. 5 is an enlarged vertical section taken along the lines 5—5 of FIG. 4.
FIG. 6 is an enlarged vertical section taken along the lines 6—6 of FIG. 4.

As seen in FIG. 4, panel 35 comprises two sheets 40 and 41 of heavy plywood secured by fasteners 42 to a surrounding frame of angle irons 43. Sheets 40 and 41 are joined in edge to edge relation by a splicing plate 44 and fasteners 45. Pad eyes 46 and 47 are welded to the angle iron frame pieces at the edges of the panel, and these pad eyes angle backwardly and outwardly for mating with like pad eyes of the next adjacent module, as seen in FIG. 5. Pad eyes 46 and 47 have holes which align with one another when the panels are in position adjacent each other, for receiving interconnecting fasteners such as bolts 50 and nuts 51, so that the panels of adjacent modules can be assembled together at joints 52.

Figures 3, 7, 8:
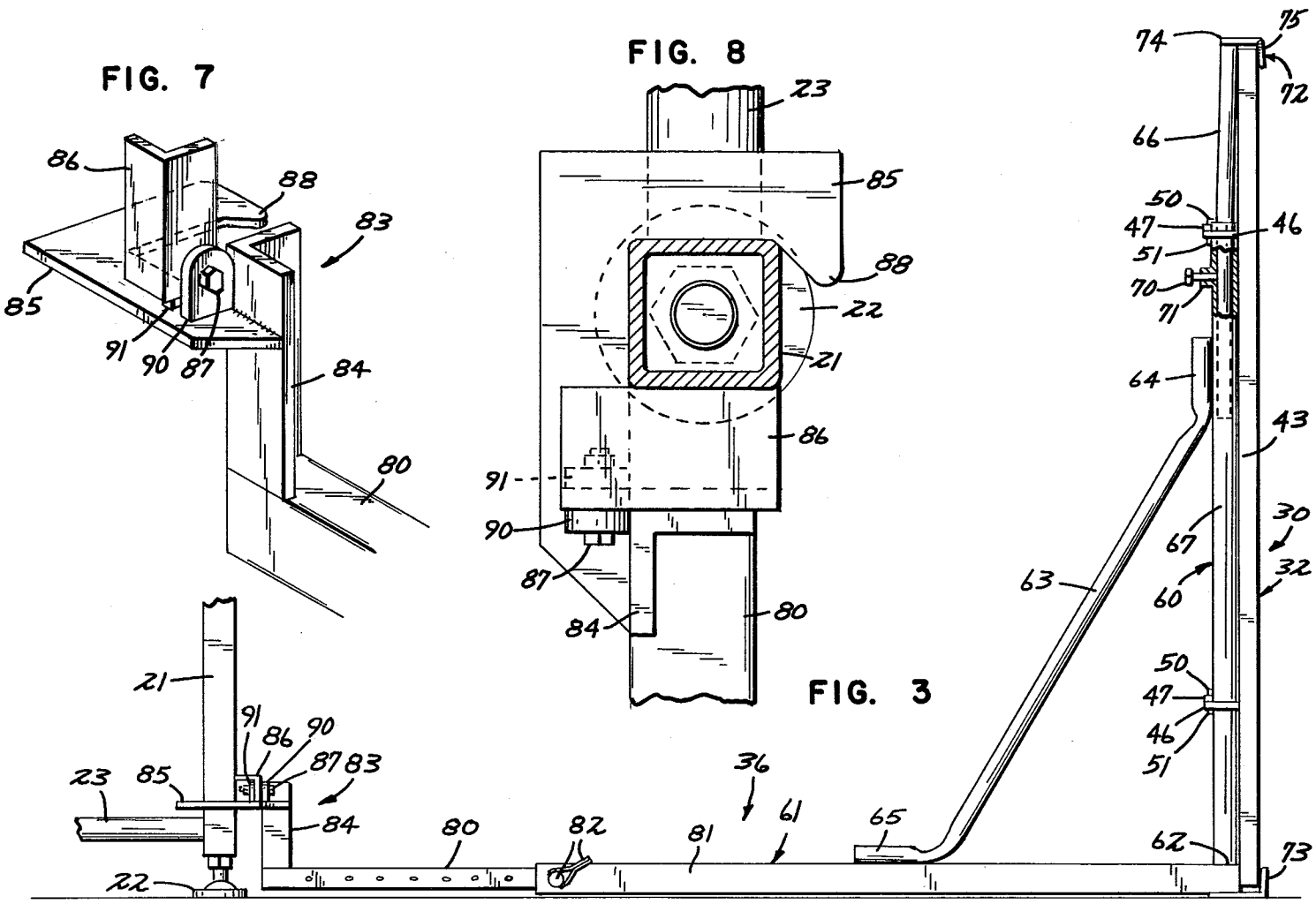
FIG. 3 is a view of the barrier in side elevation.
FIG. 7 is an enlarged perspective view of the interconnection means used for connecting the barrier to the stage leg.
FIG. 8 is a plan view of the interconnection means of FIG. 7 in use.

Bracket 36 is shown in FIG. 3 to comprise first and second tubular members 60 and 61 rigidly joined at their ends by a welded connection 62 to form a desired angle, which is ordinarily 90 degrees. Members 60 and 61 are rigidly interconnected by a diagonal brace member 63 secured at its ends 64 and 65 to sites on members 61 and 62 remote from their joined ends. In use, member 60 is intended to be generally vertical, and member 61 is generally horizontal. In the preferred embodiment, tubular member 60 is circular in section and tubular member 61 is square, as shown in the drawings. However, it will be appreciated that other shapes could be used for either member if desired.

Member 60 is telescopically adjustable and comprises an inner portion 66 slideable within an outer portion 67. Inner portion 66 is lockable in any position by a fastener 70 received in a threaded boss 71 of portion 67 to bear on portion 66. At its upper end portion 66 carries bracket means 72 to receive the upper edge and frame of a panel 35, as shown in greater detail in FIG. 6.

As seen in FIG. 6, bracket 72 comprises an angled assembly attached to the top of inner portion 66 of stage support bracket 36. Bracket 72 comprises a top portion 74 welded to the top of member 66 and extending generally outwardly over the top edge of angle iron 43 at the top of the panel. Bracket 72 also includes a flange portion 75 extending downwardly across the face of the panel to capture it. Flange 75 tapers outwardly at a slight angle so as to provide a wedging action to hold the panel. Specifically, the length of top portion 74 and the angle of flange portion 75 are selected in accordance with the nominal width of the flange of angle iron 43 so that the angle iron will be wedged between the inside surfaces of member 66 and flange 75 as shown in FIG. 6. Since there are slight variations in the nominal width of the flange portion of angle iron 43, a gap would normally be left as shown so that top member 74 can be driven downwardly with a hammer to securely wedge the panel in place. For disassembly, a few taps upwardly on the bracket 72 will release the bracket.

Bracket 73 is secured as by welding at the joint between members 60 and 61 to receive the bottom edge and angle iron frame of a panel 35.

Member 61 is also telescopically adjustable, and comprises an inner portion 80 which is slideably positioned within an outer portion 81. The positioning of member 80 within member 81 is lockable by a suitable pin 82 which passes through apertures in members 80 and 81. A plurality of apertures may be provided at different positions along members 80, to provide adjustment of the effective horizontal length of bracket 36 and the predetermined spacing between the barrier 30 and the stage 20.

At its end extending beyond portion 81, portion 80 of the horizontal part of the bracket carries releasable means 83 for making connections with the stage leg. Any suitable means for interconnection of the bracket 36 to the stage leg 21 can be provided, as for example U-bolts passing through member 80 and around leg 21. However, in the preferred embodiment the interconnection means of FIG. 7 is used. This comprises a riser 84 of angle iron secured to the end of member 80. A hook plate 85 is secured as by welding to riser 84. The preferred embodiment of the fastening means 83 is adapted for securing to a square sectioned tubular leg 21 of the stage, and accordingly hook plate 85 is shaped to receive and hold the leg as described below. In the case of a stage having a leg with a section other than square, suitable changes in the inside dimension of hook plate 85 can be made so that it will receive and hold the leg. In FIG. 7 hook plate 85 is L-shaped with one end welded to riser 84 and with a hook tip 88. The inside of the L fits two sides of the leg and the hook tip fits around a third side. The fourth side is engaged by a flipper or gate member.

Flipper or gate 86 is secured by a pivotal fastener 87 to a split bracket 90, 91 secured to plate 85. Flipper 86 is movable between a first position shown in FIG. 7, and a second position shown in FIG. 8. In its first position flipper 86 extends perpendicular to plate 85 to enable entry of a stage leg 21 into the hook plate. In its second position flipper 86 extends parallel to plate 85 and hence perpendicular to leg 21, which is thereby retained in hook plate 85.

Figure 9:
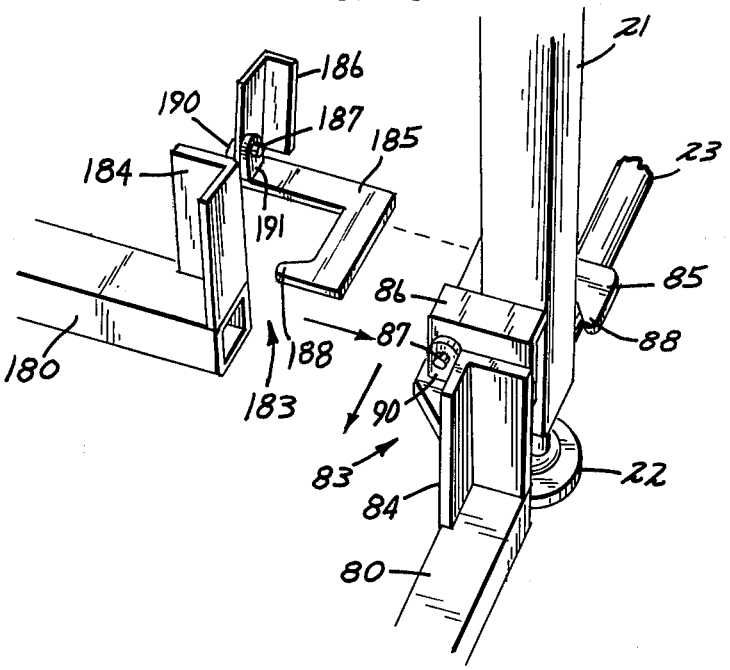
FIG. 9 is a view similar to FIG. 7 showing interconnection means for two barrier modules.
Figure 10:
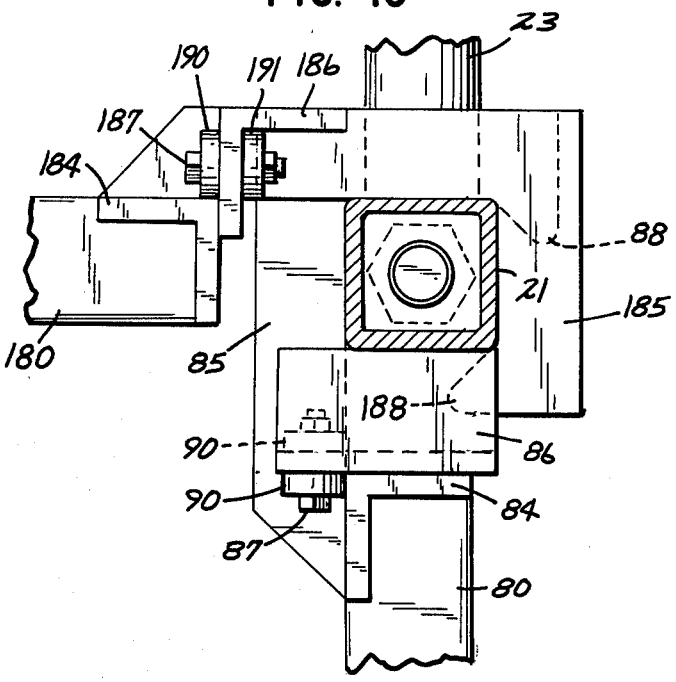
FIG. 10 is a view similar to FIG. 8 showing two interconnection means in use.

A special feature of the design of releasable means 83 is its adaptability for use when two brackets must be secured to the same stage leg, as at leg 21*a* on the corner of the stage of FIG. 2. This arrangement is seen in greater detail in FIGS. 9 and 10. FIG. 9 shows a first bracket portion 80 releasably connected to a stage leg 21, its flipper 86 being at the horizontal or locking position. A second bracket portion 180 for another module of the barrier is positioned to be connected to the same leg 21 at right angles to member 80. The flipper 186 of releasable means 183 is in its vertical or open position to receive leg 21. To secure releasable means 183 to the leg, member 180 is lifted slightly approximately the thickness of the hook plate and moved towards leg 21, while at the same time moving it slightly to the side to bring the hook portion 188 of hook plate 185 around leg 21. FIG. 10 shows the connection of releasable means 183 to leg 21 completed except that flipper 186 has not yet been pivoted to its horizontal or locking position.

Operation

In use, a pair of brackets 36 have their members 61 adjusted according to the desired predetermined spacing of the barrier 30 from stage 20, and fastener pins 82 are locked in place. The brackets 36 are spaced apart from each other according to the spacing of the legs 21 of the stage, and the brackets are secured to the stage leg 21 by the releasable means 83, as previously described. Fasteners 70 are released, allowing portions 66 to be raised to a position above the height of panel 35. Fasteners 70 can be temporarily tightened if desired to hold portions 66 in that position while panel 35 is being handled. Panel 35 is placed with its lower edge angle iron in bracket means 73 of brackets 36. Portions 66 are then lowered until bracket means 72 engage the upper angle iron edge of panel 35. Due to the tapered orientation of the flange 75 of brackets 73, they can be hit on the top by a hammer to wedge the brackets down on the angle iron, firmly holding them in place. Fasteners 70 can then be tightened, although they may not be necessary in view of the wedging action of brackets 72. This completes installation of the first module of the barrier.

The adjacent module is similarly assembled, and then connected to the first module at a side edge or joint 52 by bolt and nut 50, 51 and pad eyes 46, 47. The process is repeated until the desired length of barrier is completed. The corners of the barriers may be closed by modules such as 33, which do not require brackets but are simply fastened to front and end portions of the barrier at joints along their sides by means of the pad eyes 46, 47.

From the above it will be evident that the invention comprises an audience barrier which is of modular construction, and which is readily erected for use or taken down for storage. The barrier of the present invention is sturdy, inexpensive, and not easily subject to disassembly except from within the barrier.

What is claimed is:

1. In combination, an elevated stage having support legs, and a modular audience control barrier secured to said legs near the bottoms thereof, said barrier comprising a plurality of modules, each including a rigid panel and bracket means for supporting said panel in a vertical orientation and in spaced relation to said stage, and means interconnecting said modules in edge-to-edge relationship.

2. The combination of claim 1 in which the interconnecting means enables angular adjustment between said panels when said modules are interconnected.

3. The combination of claim 1 in which said barrier surrounds said stage.

4. A modular audience control barrier for use with an elevated stage having support legs, said barrier comprising a plurality of modules each including a rigid panel and bracket means for supporting said panel in a vertical orientation, and means interconnecting said modules in edge-to-edge relationship, said bracket means comprising a vertical member, a horizontal member connected to said vertical member, and means for securing the bottom portion of said panel, said vertical member including means for securing the upper portion of said panel, and said horizontal member including means for interconnection with the lower end of a leg of said stage.

5. Apparatus according to claim 4 in which said horizontal member is adjustable telescopically to vary the distance of said barrier from said stage.

6. Apparatus according to claim 4 in which said vertical member is adjustable telescopically to secure the upper edge of said panel.

7. Apparatus according to claim 6 in which said means for receiving said upper edge of said panel comprises a top member connected to said vertical member for extending at least part way across the top edge of said panel and a flange member extending from the top member downwardly and at a small angle outwardly from the face of the panel, whereby said flange and said vertical member may be wedged into secure relationship with the top edge of said panel by driving said vertical member downward.

8. Apparatus according to claim 4 in which the last-named means includes a hook plate for receiving the stage leg and a flipper or gate operable in a closed position to maintain said leg in said hook plate.

9. A modular audience control barrier, for use with an elevated stage having support legs, said barrier comprising, a plurality of modules, each including a rigid panel and bracket means for supporting said panel in a vertical orientation, means for interconnecting said modules in edge-to-edge relationship;

said bracket means comprising a telescoping vertical member, a telescoping horizontal member rigidly connected to said vertical member, and means for receiving the bottom edge of said panel, said vertical member including means for receiving the upper edge of said panel; and said horizontal member including means for interconnection with the lower portion of a leg of the stage.

10. Apparatus according to claim 9 wherein said means for interconnecting said horizontal member with the lower portion of a stage comprises:

a hook plate and means securing it to said horizontal member, said hook plate extending parallel to and beyond said end of said member, said hook plate being configured in conformity with the cross sectional configuration of the lower portion of said stage leg to engage more than half the periphery thereof; and a flipper pivotally connected to said hook plate for movement between an open position, in which it enables lateral insertion of said stage leg into said hook plate, and a closed position, in which it prevents lateral movement of said stage leg out of said hook plate.

11. Apparatus according to claim 10 in which said means securing said hook plate to said horizontal member comprises a vertical spacer member, whereby said hook plate engages said stage leg a distance above floor level to clear floor engaging devices at the bottom portion of the stage leg.

12. Apparatus according to claim 10 wherein said hook plate has an L-shaped configuration for engaging two sides of a rectangular cross sectioned stage leg, and a hook tip portion for engaging a third side of said leg, said flipper positioned for engaging the fourth side of said leg in its closed position.

13. Apparatus according to claim 12 wherein said hook plate is adapted for engaging a square cross sectional stage leg, whereby two such barrier modules can be positioned at right angles with their adjacent bracket horizontal members interconnected to the same stage leg.

* * * * *